US009849890B2

(12) United States Patent
Quattlebaum

(10) Patent No.: US 9,849,890 B2
(45) Date of Patent: Dec. 26, 2017

(54) MULTIDIRECTIONAL TRANSPORT SYSTEM

(71) Applicant: MAIN ATTRACTIONS, LLC, Overland Park, KS (US)

(72) Inventor: Gordon Thomas Quattlebaum, Quintana (MX)

(73) Assignee: MAIN ATTRACTIONS, LLC, Overland Park, KS (US)

( * ) Notice: Subject to any disclaimer, the term of this patent is extended or adjusted under 35 U.S.C. 154(b) by 0 days.

(21) Appl. No.: 15/217,427

(22) Filed: Jul. 22, 2016

(65) Prior Publication Data

US 2016/0325760 A1 Nov. 10, 2016

Related U.S. Application Data

(63) Continuation of application No. 14/830,487, filed on Aug. 19, 2015, now Pat. No. 9,441,329, which is a (Continued)

(51) Int. Cl.
*B61B 3/00* (2006.01)
*E01B 25/00* (2006.01)
(Continued)

(52) U.S. Cl.
CPC ..... *B61B 3/00* (2013.01); *A63G 21/20* (2013.01); *B61B 3/02* (2013.01); *B61B 7/06* (2013.01);
(Continued)

(58) Field of Classification Search
CPC ..... E01B 25/00
(Continued)

(56) References Cited

U.S. PATENT DOCUMENTS 3,880,087 A * 4/1975 Pamer ..... B61B 13/04 104/123
4,270,872 A 6/1981 Kiyosawa
(Continued)

FOREIGN PATENT DOCUMENTS

FR 2 900 834 A1 5/2011
JP 52-104333 A 9/1977
(Continued)

OTHER PUBLICATIONS

Korean Office Action of related Korean Patent Application No. 10-2012-7027420 dated Jun. 12, 2017.
Taylor-Made Play Equipment Price List 2001.

*Primary Examiner* — Jason C Smith
(74) *Attorney, Agent, or Firm* — Arent Fox LLP

(57) ABSTRACT

A transport system includes a main cable, a track assembly, and a conveyance assembly, wherein the track assembly is suspended from the main cable to allow unimpeded translational movement of the conveyance assembly along the track assembly. In another aspect according to the present invention, the track assembly has a track changing assembly that includes a track changing section rotatably coupled to a primary track section for selective alignment of the track changing section to any one of a plurality of exit track sections. A method of conveyance along a suspended track includes suspending a main cable between natural or artificial support structures, suspending a track assembly from the main cable, and mounting a conveyance assembly on the suspended track assembly to provide unimpeded translational movement of the conveyance assembly along the track assembly.

16 Claims, 13 Drawing Sheets

Related U.S. Application Data continuation of application No. 14/303,503, filed on Jun. 12, 2014, now Pat. No. 9,139,206, which is a continuation of application No. 13/580,569, filed as application No. PCT/US2011/029177 on Mar. 21, 2011, now Pat. No. 8,863,668.

(60) Provisional application No. 61/315,619, filed on Mar. 19, 2010.

(51) Int. Cl.

| | |
|---|---|
| ***B61B 3/02*** | (2006.01) |
| ***B61B 7/06*** | (2006.01) |
| ***B61B 12/02*** | (2006.01) |
| ***E01B 25/18*** | (2006.01) |
| ***E01B 25/24*** | (2006.01) |
| ***E01B 25/26*** | (2006.01) |
| ***A63G 21/20*** | (2006.01) |

(52) U.S. Cl.
CPC ..... *B61B 12/02* (2013.01); *E01B 25/00* (2013.01); *E01B 25/18* (2013.01); *E01B 25/24* (2013.01); *E01B 25/26* (2013.01)

(58) Field of Classification Search
USPC ..... 104/112, 111, 113, 115, 123, 124, 172.4, 104/94, 95, 87, 106, 108
See application file for complete search history.

(56) References Cited

U.S. PATENT DOCUMENTS

| | | | | |
|---|---|---|---|---|
| 5,038,900 | A * | 8/1991 | Durant | D01H 9/182 198/465.4 |
| 5,149,149 | A | 9/1992 | Wu | |
| 5,231,932 | A * | 8/1993 | Enderlein | B65G 19/025 104/162 |
| 6,138,574 | A * | 10/2000 | Zaguroli, Jr. | E01B 25/24 104/106 |
| 6,745,891 | B2 * | 6/2004 | Walter | B61B 10/025 104/172.4 |
| 6,758,325 | B2 * | 7/2004 | Greeley | B61B 3/00 198/465.4 |
| 7,823,511 | B2 | 11/2010 | Lins et al. | |
| 8,042,474 | B2 | 10/2011 | Perakis | |
| 8,171,857 | B2 | 5/2012 | Bischofberger | |
| 2008/0229967 | A1 * | 9/2008 | Lins | A63G 21/22 104/173.1 |
| 2009/0293757 | A1 * | 12/2009 | Bischofberger | B61B 12/02 104/123 |
| 2010/0107919 | A1 * | 5/2010 | Perakis | A63G 21/22 104/112 |
| 2013/0042784 | A1 * | 2/2013 | Quattlebaum | B61B 3/02 104/123 |

FOREIGN PATENT DOCUMENTS

| | | | |
|---|---|---|---|
| JP | 55-066856 | U | 5/1980 |
| JP | 55-140643 | A | 11/1980 |
| JP | 04-112884 | U | 10/1992 |
| JP | 2001-302173 | A | 10/2001 |
| JP | 2006-076756 | A | 3/2006 |
| KR | 10-2008-0086337 | A | 9/2008 |

* cited by examiner

MULTIDIRECTIONAL TRANSPORT SYSTEM

CROSS-REFERENCED TO RELATED APPLICATION

This application is a Continuation of U.S. application Ser. No. 14/830,487, filed on Aug. 19, 2015, which is a Continuation of U.S. application Ser. No. 14/303,503, filed on Jun. 12, 2014, now U.S. Pat. No. 9,139,206, which is a Continuation of U.S. application Ser. No. 13/580,569, now U.S. Pat. No. 8,863,668, filed on Oct. 12, 2012, which is the U.S. National Stage entry of International Application PCT/US2011/029177, filed on Mar. 21, 2011, which claims priority to U.S. Provisional Patent Application No. 61/315,619 filed on Mar. 19, 2010. The disclosures of the prior applications are hereby incorporated in their entirety by reference.

BACKGROUND

Field

Aspects of the present invention relate to a track system, including the devices and structures incorporated therein, and the installation and methods of use thereof, for the movement of persons and/or payloads over a specified course.

Description of the Related Art

Many track systems exist for the transport of people and/or payloads for recreation, science and/or commercial endeavors. In particular, track systems, such as roller coasters, mountain coasters, and tramways, for example, and cable systems such as zip lines, ski lifts, and rope pulleys, exist for moving people and/or payloads over distinct distances and terrains.

Although the track systems may be designed to be multidirectional, the infrastructure required to support the rigid installation is often costly and has a significant impact on the environment. On the other hand, although cable systems may be cheaper to install, maintain and operate, cable systems lack the ability to be completely multidirectional, wherein a user may experience ascents, descents, and/or left and right turns in any combination without having to disengage from the main cable system. For example, the cables in such cable systems, such as those typically used in recreational canopy tours and rope courses, often have to be set at an angle so there is a level difference between the start and end points so that the body weight of the user under the effect of gravity serves as the driving force. The user often hangs from the cable through a pulley to which he is attached using straps, hooks and a harness. These methods are inconvenient because they can only be used one way (i.e., downwards) and there may be no real control of the speed. In addition, the cables are limited to the length of distance between two tie-off points and/or the limits of safe cable spans. As such, the user must stop at various points of cable anchorage, which may be fitted with a platform, for example, remove his weight from the cable, separate himself from the pulley and/or cable, and then re-attach again to another pulley and/or cable in order to be able to continue on his descending tour.

There exists a need for a transport system that provides the benefits of a cable system with the multidirectional aspects of a track system, one which does not require the rigid infrastructure of conventional track systems yet permits ascending, descending, leftward and/or rightward movement along a predesigned pathway without having to disengage the user and/or payload from the cable or track in order to do so. Furthermore, there is a need to provide a track system that allows users the ability to switch unassisted and safely between a choice of different track pathways while remaining continuously connected to the track system.

SUMMARY

A multidirectional transport system is entirely supported by suspended cables, requiring no rigid installation. A system track assembly is supported by the overhead cables. A conveyance assembly, which includes a wheeled trolley assembly, is able to transport a person and/or payload freely past all track supports, enabling the track assembly to be of unlimited length and configuration. The track assembly is suspended from the cable in such a manner that the track movement is limited and not substantially affected by the weight of a user, allowing more exacting control of a conveyance assembly for safer landings and safely distancing the user from fixed objects, such as trees, for example, and the ground.

The multidirectional transport system may allow a user to land unassisted and safely traverse ascents, for example, while continuously remaining connected to the track system. A track system may be configured to provide users the ability to choose different track routes without having to disengage from the track system to do so. Safety aspects including a ratchet type anti-reverse system allow users the ability to regain height along portions of the system, for example, while remaining safe from a fall and/or uncontrolled slide backwards down the ascent.

The multidirectional transport system may be used in a wide variety of ways, for example, including, but not limited to, zip-lining, flight simulation, multi-jump water slides, track assisted snow skiing allowing high jumps, and/or running close to or over cliffs. In another aspect of the system, vehicles adapted for use on the track system may be used for the transport of persons, including use of the vehicle described in U.S. Patent Application Publication No. 2008/0202375, the entirety of which is incorporated herein by reference.

In yet another aspect according to the present invention, a method of conveyance along a suspended track includes suspending a main cable between natural or artificial support structures, suspending a track assembly from the main cable, and mounting a conveyance assembly on the suspended track assembly to provide unimpeded translational movement of the conveyance assembly along the track assembly.

It is understood that other aspects of a multidirectional transport system will become readily apparent to those skilled in the art from the following detailed description, wherein it is shown and described only exemplary configurations of a multidirectional transport system. As will be realized, the invention includes other and different aspects of a multidirectional transport system and the various details presented throughout this disclosure are capable of modification in various other respects, all without departing from the spirit and scope of the invention. Accordingly, the drawings and the detailed description are to be regarded as illustrative in nature and not restrictive.

DETAILED DESCRIPTION

Figure 1:
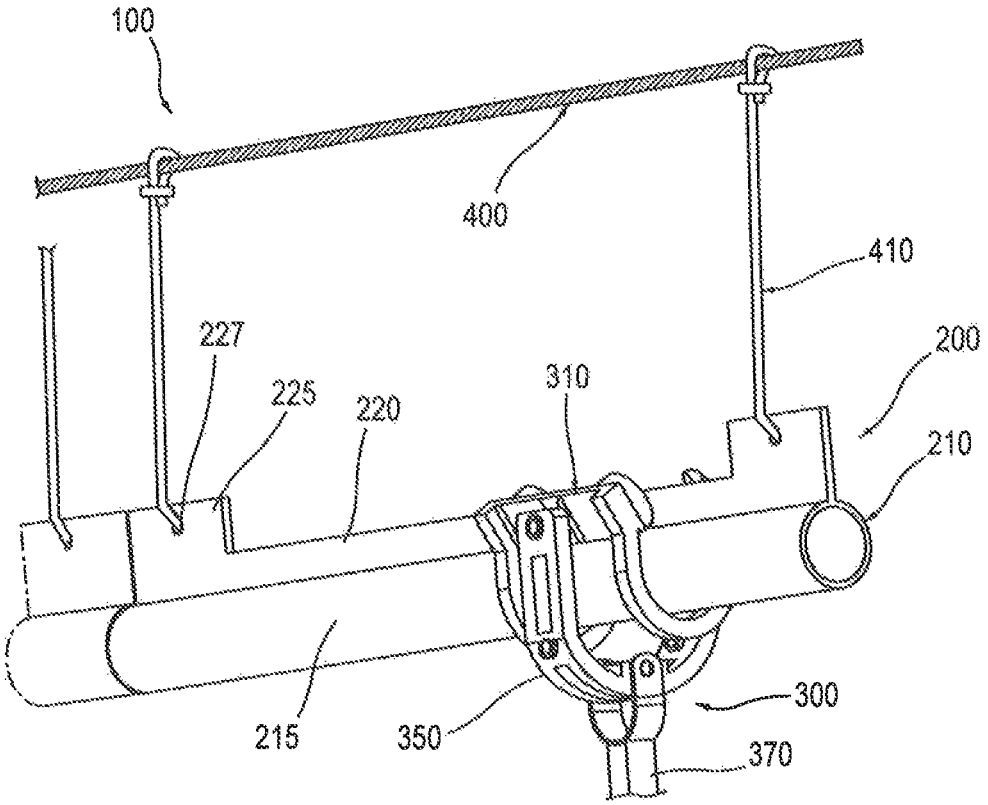
FIG. 1 is a perspective view of a portion section of a multidirectional track system, in accordance with aspects of the present invention.

The present invention is described more fully hereinafter with reference to the accompanying drawings, in which various aspects of a multidirectional track system are shown. This invention, however, may be embodied in many different forms and should not be construed as limited by the various aspects of the multidirectional track system presented herein. The detailed description of the multidirectional transport system is provided below so that this disclosure be thorough and complete, and will fully convey the scope of the present invention to those skilled in the art.

The detailed description may include specific details for illustrating various aspects of a transport system. However, it will be apparent to those skilled in the art that the invention may be practiced without these specific details.

Various aspects of a multidirectional transport system may be illustrated by describing components that are coupled together. As used herein, the term "coupled" is used to indicate either a direct connection between two components or, where appropriate, an indirect connection to one another through intervening or intermediate components. In contrast, when a component referred to as being "directly coupled" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of an apparatus in addition to the orientation depicted in the drawings. By way of example, if an apparatus in the drawings is turned over, elements described as being on the "bottom" side of the other elements would then be oriented on the "top" side of the other elements. The term "bottom" can therefore encompass both an orientation of "bottom" and "top" depending on the particular orientation of the apparatus.

Various aspects of a multidirectional track system may be illustrated with reference to one or more exemplary embodiments. As used herein, the term "exemplary" means "serving as an example, instance, or illustration," and should not necessarily be construed as preferred or advantageous over other embodiments of a multidirectional transport system disclosed herein.

As shown in FIG. 1, a multi-directional transport system 100 includes a track assembly 200 and a conveyance assembly 300. The track assembly 200 is suspended from a main cable 400 which, in turn, is suspended in a manner to allow unimpeded translational movement of a person or payload, for example, by the conveyance assembly 300 along the track assembly 200.

The track assembly 200 may include a combination of interconnected straight and/or shaped primary track sections 210. The primary track sections 210 may be formed from any suitable rigid, high-strength material, including steel, iron, or aluminum, for example. The shaped primary track sections 210 may be formed to curve left and/or right, up and/or down, or any combination thereof in order to provide a pathway segment of predetermined directional capabilities. By interconnecting any combination of shaped primary track sections 210, the track assembly 200 may be configured to provide an open or closed-loop pathway, for example. Moreover, track changing assemblies 240 may be provided to branch a single pathway into multiple pathways and/or to consolidate multiple pathways into fewer pathways or a single pathway, for example. Accordingly, an infinite variety of configurations of pathways or networks of pathways are possible in the multi-directional transport system 100 that can be easily constructed and routed for efficient transport of persons and/or payload without the length and directional restrictions of conventional technologies.

Figure 2:
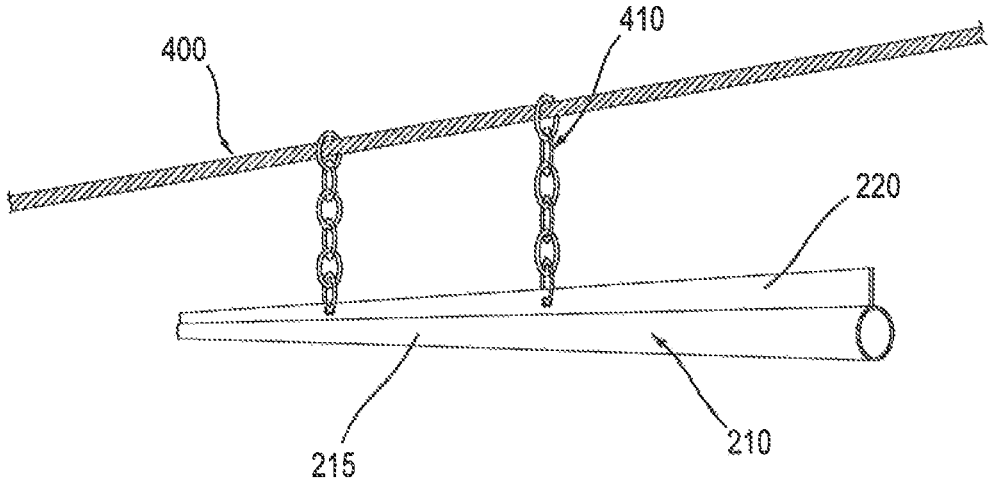
FIG. 2 is perspective view of a track section, in accordance with aspects of the present invention.

As shown in FIGS. 1 and 2, a primary track section 210 includes a rigid traveler section 215, which may be a straight or curved pipe, for example, to provide directional variance to the track section 210. A guide fin 220 extends longitudinally along an external peripheral surface of the traveler section 215. The guide fin 220 preferably extends along an upper peripheral surface of the traveler section 215 at or near a longitudinal centerline of the traveler section 215.

Support tabs 225 may be formed or joined, such as by welding, for example, on the external peripheral surface of and at various points along the traveler section 215. The support tabs 225 may have through-holes 227, or any other suitable attachment mechanism, for connecting the primary track section 210 to cable supports 410. The cable supports 410 may be any suitable support for securely suspending the primary track section 210 from the main cable 400, such as chains and/or steel cables. The number and type of cable supports 410 may be configured to provide various degrees of freedom of movement of the track sections 210, for example, to avoid the development of excess metal fatigue in the rigid track sections 210 as a result of the variable cyclic loading. In accordance with another aspect of the present invention, the support tabs 225 may be integrally formed to extend directly from the guide fin 220. In this manner, the gravitational effect of suspending the track section 210 will automatically position the guide fin 220 to extend along the upper longitudinal centerline of the track section 210.

Figure 3:
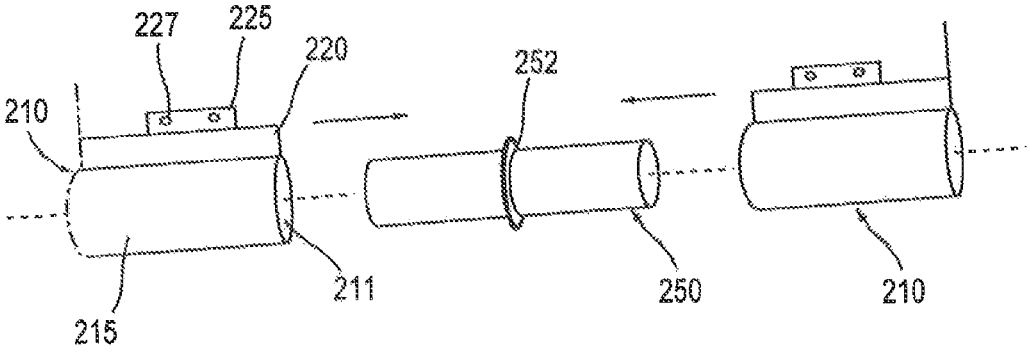
FIG. 3 is a perspective view of a track coupler, in accordance with aspects of the present invention.
Figure 4:
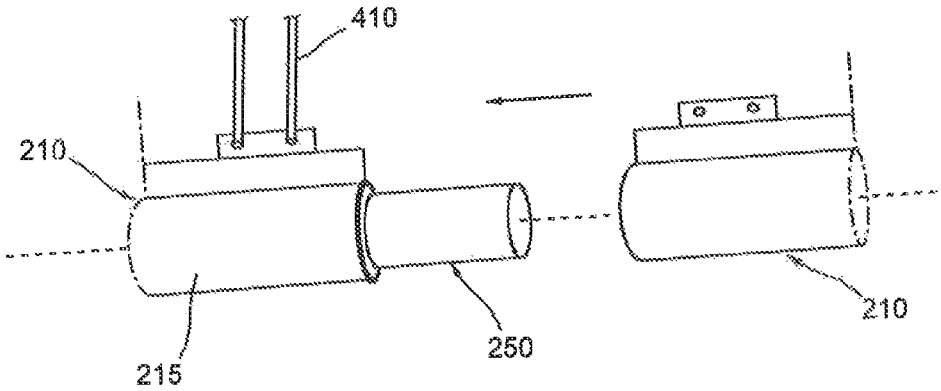
FIG. 4 is another perspective view of a track coupler, in accordance with aspects of the present invention.

As shown in FIGS. 3 and 4, individual track sections 210 may be coupled together using a track coupler 250. The track coupler 250 may be any connection mechanism for non-permanently coupling a track section 210 to another track section 210 or a track changing assembly. The track coupler 250 may be a rigid component of iron or steel, for example, that is configured to be slidably received into a hollow end 211 of the track section 210. A retention collar 252 may be formed on the track coupler 250 to prevent the track coupler 250 from extending beyond a predetermined point into the hollow end 211 of the track section 210. In this manner, the track assembly 200 may be formed by serially connecting various track components, the track sections 210 and/or the track changing assemblies 240, for example. Once assembled, the cable supports 410 are configured to keep the components substantially together at each end, with the track couplers 250 providing rigid support and continuity at the junctions. The track coupler 250 is formed to extend far enough into the abutting hollow ends 211 of connected track sections 210, for example, to prevent separation of the track sections 210 while permitting a certain degree of rotational and longitudinal movement of the individual components. The retention collar 252 prevents the track coupler 250 from completely sliding into either one of the abutting hollow ends 211 of the connected track sections 210 in order to prevent decoupling as the result of any unintentional separation of the track sections 210. The loose coupling of the track components in this manner prevents excess fatigue from developing in the substantially rigid structure of the track assembly 200 due to the variable cyclic loading experienced during use of the suspended system 100.

FIGS. 5-8 illustrate an exemplary track changing assembly 240, in accordance with aspect of the present invention. The track changing assembly 240 allows a user to change from the track pathway currently being travelled to another track pathway. The transfer may be accomplished by the user individually without the need of assistance from a guide, for example, as the user remains attached to the track system during the transfer. The track changing assembly 240 allows connection of system tracks in a circular pattern, thus several track sections 210 may be offered at any track changing point. For example, users may choose different track pathways by rotating the track changing assembly toward a pathway of particular difficulty and/or of desired configuration, including exit tracks which safely transport a user to ground level for exiting the system.

Figure 5:
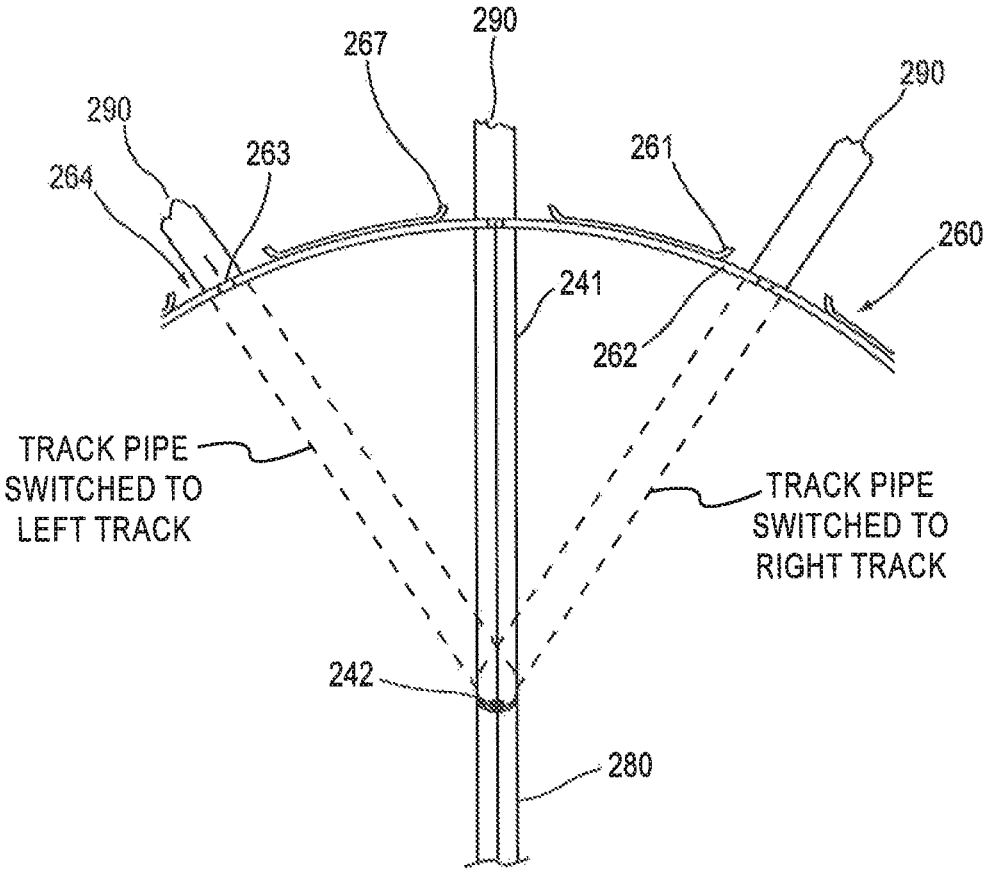
FIG. 5 is a top view of an exemplary track changing assembly, in accordance with aspects of the present invention.

The track changing assembly 240 is designed for use with the user stopped and standing. The track changing assembly 240 includes a track changing section 241 supported at one end by a hinged coupling to an incoming track section 280 and at the other end by a distributing arc supporting unit 260. At least one outgoing track section 290 is fixedly attached to the distributing arc supporting unit 260. As shown in FIG. 5, the track changing section 241, which may preferably be a track pipe of similar radial dimension to the primary track sections 210, is hinged in such a manner to allow the trolley to pass the hinge pin 242 and move freely onto the track changing section 241 from the incoming track section 280.

Figure 6:
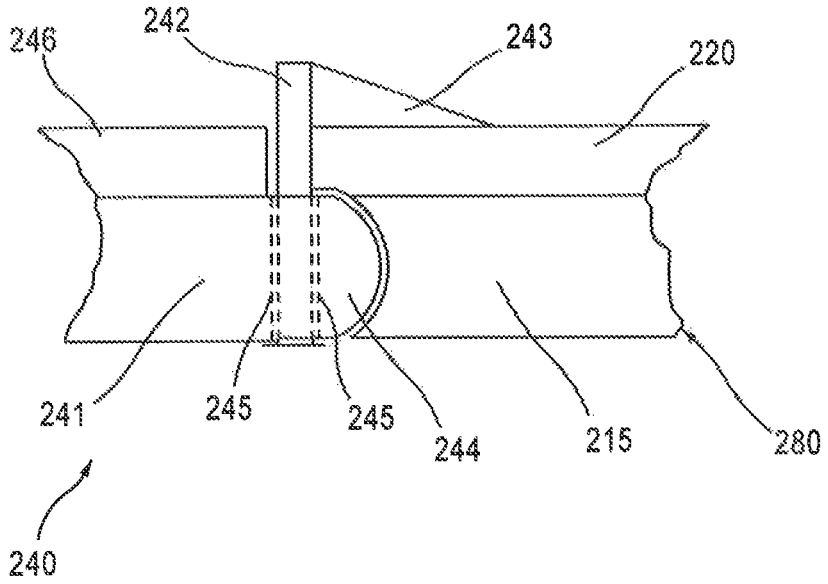
FIG. 6 is a &de plan view of an exemplary hinged connection between an incoming track section and a track changing assembly, in accordance with aspects of the present invention.

FIG. 6 shows in more detail an exemplary hinged coupling of the track changing assembly 240 to an incoming track section 280, in accordance with aspects of the present invention. The hinge pin 242 may be welded on an incoming side to the guide fin 220 of the incoming track section 280. The outgoing side of the hinge pin 242 remains free. A pin brace 243 may be provided to lend additional support to the rigid connection of the hinge pin 242 to the guide fin 220. The traveler section 215 of the incoming track section 280 may be cut to permit clearance for a proximal end 244 of the track changing section 241 to rotatably mount to the hinge pin 242. A sleeve 245, for example, may be provided to rotatably receive the hinge pin 242 through the proximal end 244 of the track changing section 241. The track section 241 may thus rotate in a left or a right direction about the hinge pin 242.

Once on the track changing section 241, the user may freely move the changing section 241, such as by rotation, to align the track changing section 241 with an outgoing system track section 290 on the track pathway desired. As shown in FIG. 5, the distal end of the track changing section 241 is supported on the distributing arc supporting unit 260. The various outgoing track sections 290 for choice may be fixedly attached to a peripheral surface of the distributing arc supporting unit 260.

Figure 7:
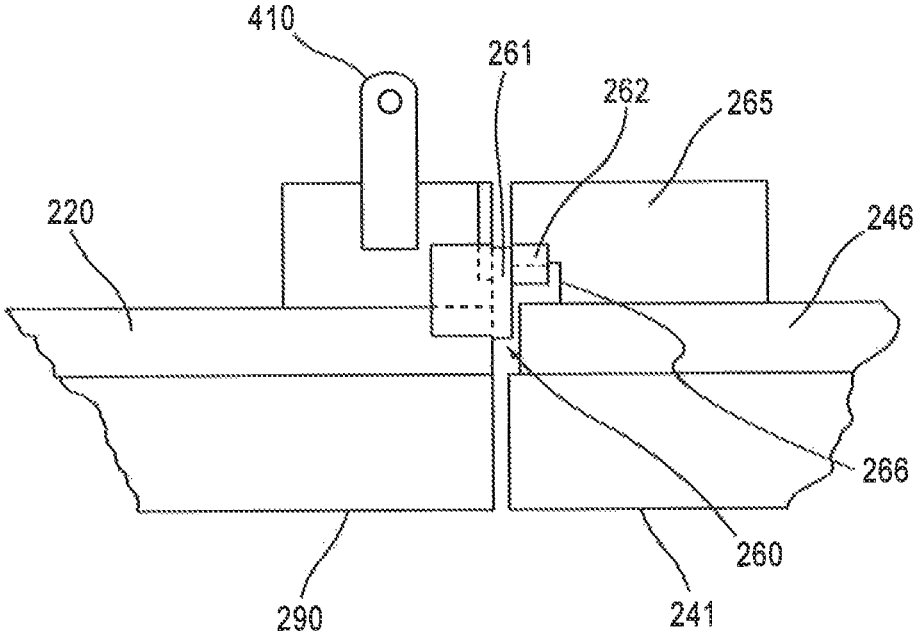
FIG. 7 is a side plan view of an exemplary distributing arc supporting unit, in accordance with aspects of the present invention.

FIG. 7 illustrates a side view of an exemplary distributing arc supporting unit 260 in accordance with aspects of the present invention. The distributing arc supporting unit 260 includes a radial safety guide portion 261 and an inner annular guide track portion 262. A guide tab 265 having a notched cutout portion 266 may be provided to slide along the guide track portion 262. The guide tab 265 may be fixedly attached at the distal end of the track changing section 241, and, for example, may extend from the guide fin of the track changing section 241. The guide tab 265 may be fitted with a bearing, for example, to allow easier movement of the track changing section 241 along the annular guide track portion 262.

Figure 8:
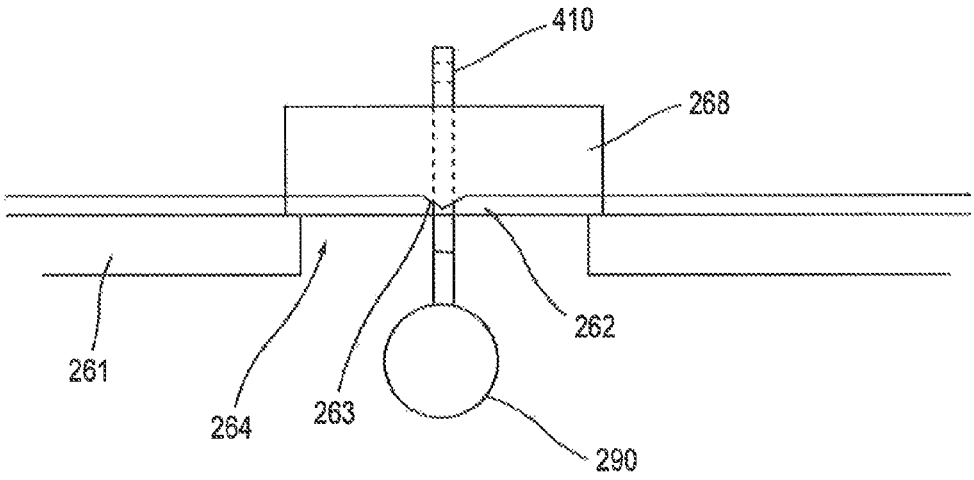
FIG. 8 is a radial view of portions of an exemplary track changing assembly, in accordance with aspects of the present invention.

As shown in FIGS. 5 and 8, the annular guide track portion 262 may be provided with a groove 263, such as a small "v" groove, which acts to catch the guide tab 265 as the track changing section 241 is rotated along the annular guide track portion 262. In this manner, a user may rotate the track changing section 241 to a desired track pathway along the distributing arc supporting unit 260. At each groove 263, the user may feel a natural alignment of the track changing section 241 with an outgoing track section 290 when the guide tab 265 drops into the groove 263. If the user desires to pass onto the aligned outgoing track section 290, the user translates the trolley assembly 310 forward onto the outgoing track section 290. Otherwise, the user may continue to rotate the track changing section 241 to align with a different outgoing track section 290. The radial safety guide 261, which may be, for example, a flat metal strip welded to the outer periphery of the annular guide track portion 262, prevents the trolley assembly 310 from passing except when the track changing section 241 is properly aligned with an outgoing track section 290. The radial safety guide 261 extends from the annular guide track portion 262 low enough to block the trolley assembly from passing onto an outgoing track section except at specified alignment gaps 264.

In accordance with another aspect of the present invention the ends of the radial safety guide 261 on either side of an alignment gap 264 may be provided with angled guides 267 to catch and steer the trolley assembly 310 in a manner that ensures alignment of trolley assembly 310 during the transition from the track changing section 241 to the chosen track section 290. For example, as shown in FIG. 5, the angled guides 267 may be formed by bending outward the ends of the radial safety guide 261 on each side of the alignment gaps 264.

The distributing arc support unit 260 allows the trolley assembly 310 to move onto a chosen outgoing track section 290 only when the track changing section 241 is in proper alignment, while preventing the trolley assembly 310 from disengaging from the track system. The track changing assembly 240 may be supported from above by supports 410, for example, such as those described above with respect to support of the primary track sections 210. Supports 410 may be attached to the guide fin 246 of the track changing section 241, for example. An attachment plate 268, as shown in FIG. 8, may provide support to the distributing arc support unit 260 as well as additional anchor points for support of the track changing assembly 240. In another aspect of the present invention, a rigid frame, for example, may provide support to the track changing assembly 240.

Although described above wherein the user is engaged with the ground or a platform, for example, in order to twist and swivel the track changing section 241 to a chosen outgoing track section 290, a track changing assembly 240 may include means for changing pathways while freely suspended, including for example, connecting the track changing section 241 above the guide fin 246 to support poles which could be framed below the feet of the user and secured with cables to stabilize the entire track changing assembly 240 and the poles.

As shown in FIG. 1, the conveyance assembly 300 includes a trolley assembly 310 coupled to a swing arm 350. A transport assembly 370 is attached to the swing arm 350 for supporting a person or payload, for example, during transport along the track assembly 200.

Figure 9:
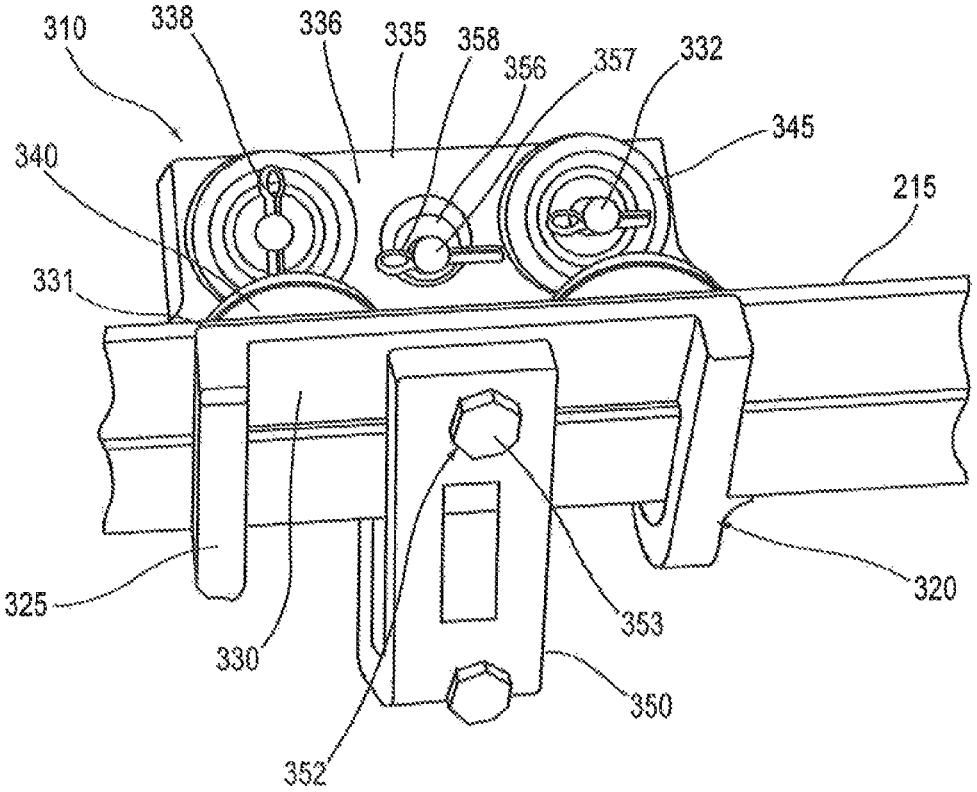
FIG. 9 is a perspective view of a trolley assembly and swing arm, in accordance with aspects of the present invention.
Figure 10:
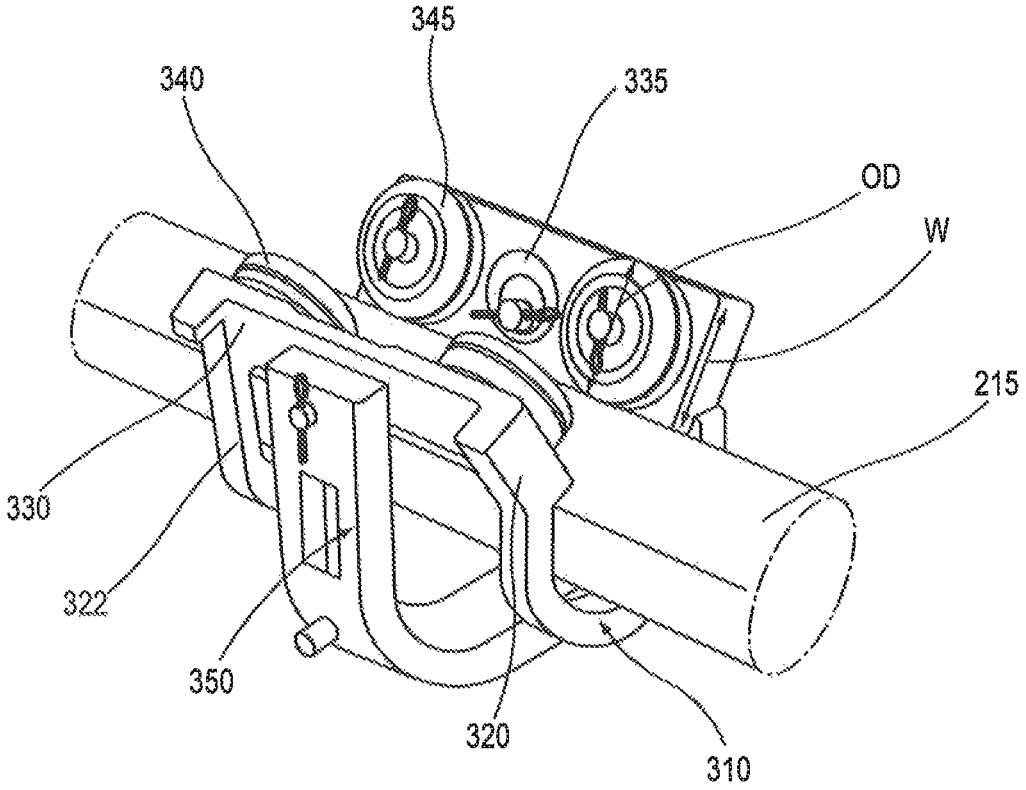
FIG. 10 is another perspective view of a trolley assembly and swing arm, in accordance with aspects of the present invention.

As shown in FIGS. 9 and 10, the trolley assembly 310 includes a trolley frame 320 of rigid construction formed with undercarriage supports 325, a left wheel mounting plate 330 and a right wheel mounting plate 335. The trolley frame 320 is preferably made of steel, but may be made of any suitable load bearing material designed to accommodate the contemplated loads while providing a sufficient factor of safety for the contemplated use. One or more left wheels 340 may be rotatably mounted on an inner surface 331 of the left wheel mounting plate 330, and one or more right wheels 345 may be rotatably mounted on an inner surface 336 of the right wheel mounting plate. The left and right wheels 340 and 345 may be formed from any suitable material designed for the appropriate loads, such as a hard, durable, impact resistant plastic, for example. Any suitable method of rotatably coupling the wheels 340 and 345 to the trolley frame 320 may be used. For example, the left and right wheel mounting plates 330 and 335 may be provided respectively with left and right wheel mounting posts 332 and 337. The left and right wheels 340 and 345 may be mounted onto the respective left and right mounting posts 332 and 337 and secured by cotter pins 338, for example, held in pin holes formed in each mounting post. The mounting posts 332 and 337, in conjunction with the cotter pins 338, allow easy and efficient assembly and removal of the wheels 340 and 345 during construction and/or maintenance, for example, of the track system 100.

Figure 11:
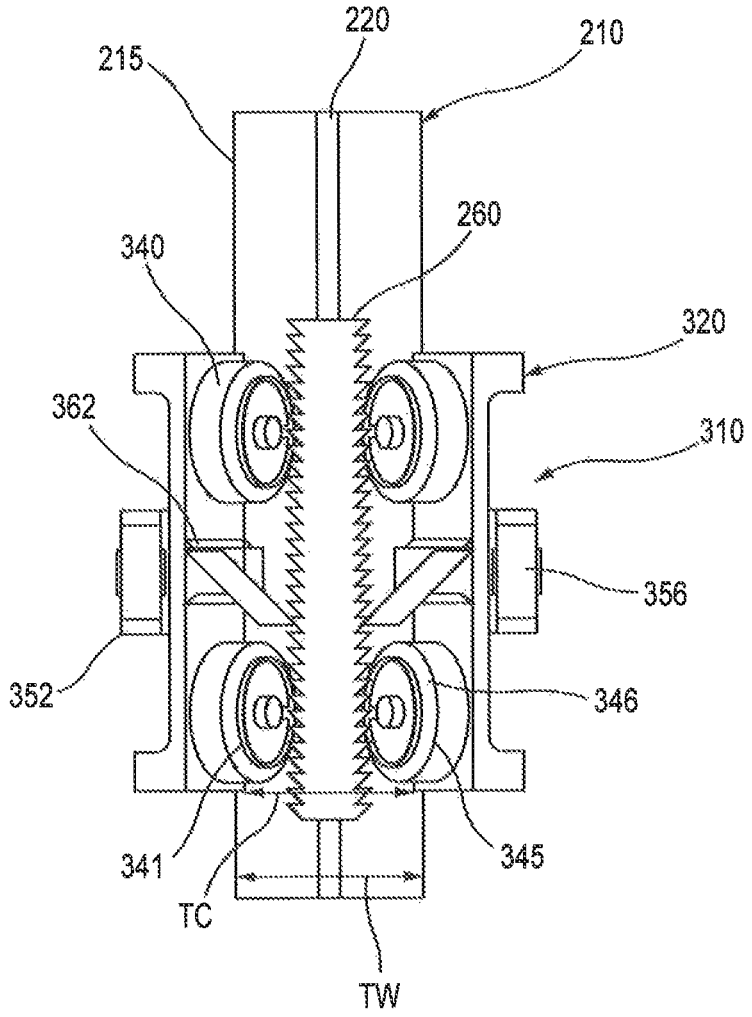
FIG. 11 is a top view of a trolley assembly and anti-reverse features, in accordance with aspects of the present invention.

The trolley frame 320 may be configured with the mounting plates 330 and 335 angled, as shown, for example, in FIGS. 9-11. FIG. 11 shows that a minimal transverse clearance TC may be provided between the angled mounting plates 330 and 335 that is smaller than a transverse width TW of the traveler section 215, which may be the outer diameter of a pipe, for example. Because the transverse width TW of the traveler section 215 is greater than the transverse clearance TC of the angled mounting plates, the trolley assembly 310 is assured against dislodging from the traveler section 215 once the conveyance assembly 300 is mounted to a completed track assembly 200. Thus, even in the event of a catastrophic failure of one or more wheels, for example, the trolley frame 320 will catch and be supported on the traveler section 215, preventing any complete disconnect of the conveyance assembly 300 from the track assembly 200.

As shown in FIG. 10, the wheels 340 and 345 may be formed to have an outer diameter OD of dimension slightly greater than a transverse width W of the mounting plates 330 and 335 to prevent interference of the frame assembly 220 with the traveler section 215. In accordance with another aspect of the present invention, the wheels 340 and 345 may be mounted with a lower contact portion extending radially inward toward the traveler section 215 more than the inward radial extension of the mounting plates 330 and 335. Accordingly, the wheels 340 and 345 provide sufficient clearance between the trolley frame 320 and the traveler section 215 when the trolley assembly 310 is mounted on a track section 210.

The undercarriage supports 322 provide transverse structural support to the trolley assembly 310. The undercarriage supports 322 are configured to rigidly connect the left and right mounting plates 330 and 335 while straddling the traveler section 215 below the track section 210 when the trolley assembly 310 is mounted on the track assembly 200. For example, as shown in FIGS. 1, 9 and 10, the undercarriage supports 332 may be U-shaped struts attaching the left and right mounting plates 330 and 335 at or near the longitudinal ends of the trolley assembly 310. In this manner, the upper portion of the trolley assembly 310 remains open to permit translational movement of the trolley assembly 310 along the track assembly 200 without interference from the cable supports 410.

The left and right wheels 340 and 345 may be formed respectively with beveled inner surfaces 341 and 346, for example, to facilitate smooth translational movement of the trolley assembly 310 while permitting a degree of circumferential side-to-side rocking, for example. In this manner, the conveyance assembly 300 may easily and comfortably respond to the centrifugal force, for example, of a person or payload being carried at speed around a turn. In combination with the degree of movement provided by the suspended track section 210, the ability of the trolley assembly 310 to move circumferentially on the traveler section 215 allows the system to effectively absorb the cyclic loading placed on the system while also providing users, for example, a safer and more controlled sensation during travel along the track assembly 200. The guide fin 220 limits the amount of circumferential motion of the trolley assembly 310 and prevents the trolley assembly 310 from becoming misaligned and possibly hitting a cable support 410 during travel.

As shown in FIGS. 1, 9 and 10, the swing arm 350 may be a rigid steel bracket, for example, that is rotatably coupled to the trolley frame 320 at left and right hinge joints 352 and 356. Left and right hinge bolts 353 and 357, secured respectively by left and right hinge pins 354 and 358, for example, may be used to hinge the swing arm 350 to the trolley assembly 310. The swing arm 350 may be configured to transversely straddle the travel section 215 below the track section 210 and may be attached to the trolley assembly 310 toward a longitudinal centerline of the trolley assembly 310. The swing arm 350 supports and distributes the load of the suspended transport assembly 370 and any person, vehicle and/or payload to the trolley frame 320 while permitting the transport assembly 370 the freedom to swing back and forth in a substantially longitudinal direction.

One or more rollers may be provided to extend from the lateral lower portion of the swing arm 350 to control the degree of rotation of the swing arm 350. For example, extreme speed on an incline or decline could cause the swing arm 350 to longitudinally rotate to such a degree that a user could potentially collide with the track. In that case, the swing arm roller may prevent rotation of the swing arm 350 beyond a certain degree without causing any substantial jarring of the user, vehicle and/or payload. In accordance with another aspect of the present invention, the swing arm roller may be configured to act as a resistance brake in cases where it is determined that a possible dangerous speed angle combination may require a reduction in speed. In another aspect of the system, a braking mechanism, such as a friction pad and/or a friction roller, may be mounted to the swing arm and electronically actuated, for example, or mechanically actuated by a user, such as by a hinge and pulley mechanism, to provide a braking capability to the conveyance assembly 300.

Figure 12:
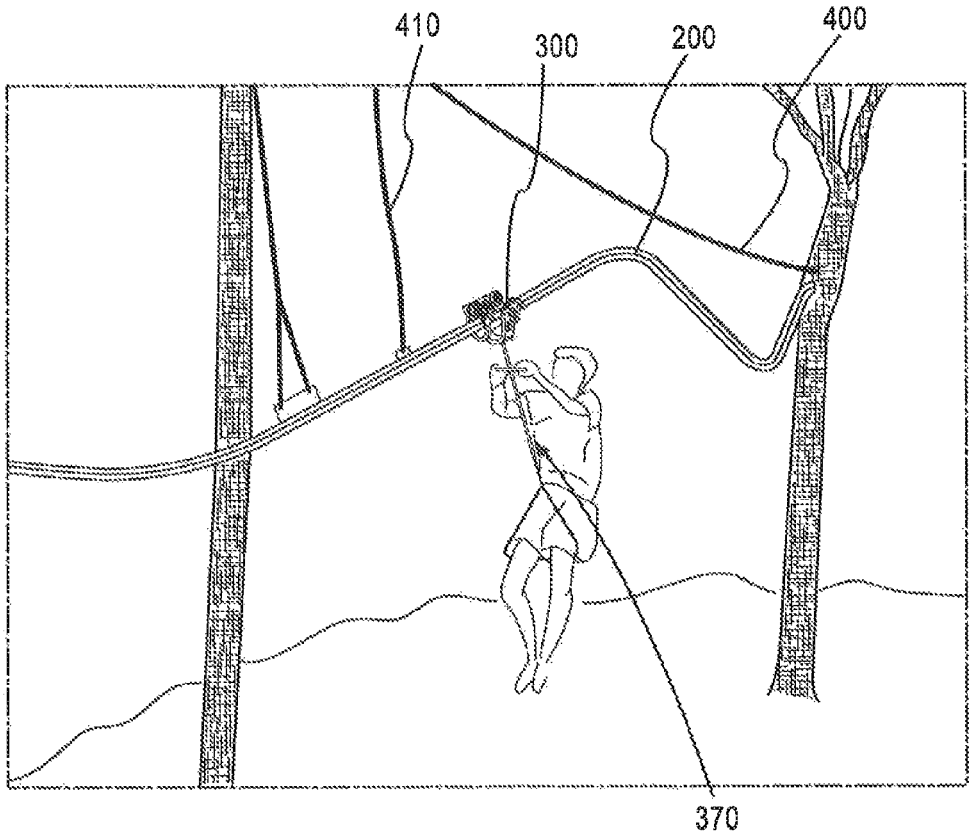
FIG. 12 is a perspective view of a multidirectional track system, in accordance with aspects of the present invention.

In use, the transport assembly 370 may be coupled to the swing arm 350 to provide a mount for a user and/or a payload. As shown in FIG. 12, the transport assembly 370 may be a seat harness for a person, for example. The person may navigate around the track assembly 200 by pushing or walking, for example, to translate the conveyance assembly 300 over flat and/or inclined sections of track, while allowing gravity and/or momentum, for example, to translate the conveyance assembly 300 over declined or flat sections of track.

As shown in FIG. 11, certain track sections 210, such as ascending portions of the track assembly 200, may be fitted or formed with a linear rack 260 that works in tandem with one or more pawls 362 to provide a ratchet type anti-reverse system for restricting the translational motion of the trolley assembly 310 to one direction. The linear rack 260 may be positioned along the longitudinal centerline of the traveler section 215 so that the trolley assembly 310 may pass without interference. The pawls 362 may be mounted on the trolley frame 320 and positioned as shown to slide gently over the sloped services of the rack teeth when traveling in a forward direction, for example, while locking into the depression between the rack teeth if translated in a reverse direction. The pawls 362 may be spring forced against the rack 260 to ensure engagement with the rack teeth as the trolley assembly 310 travels past the rack 260. In this manner, an individual connected to the track may ascend with a rising track assembly 200 using stairs, ladders or other rope course type means, for example, while being protected from a fall or an uncontrolled backward slide down a slope by the anti-reverse.

Figure 13:
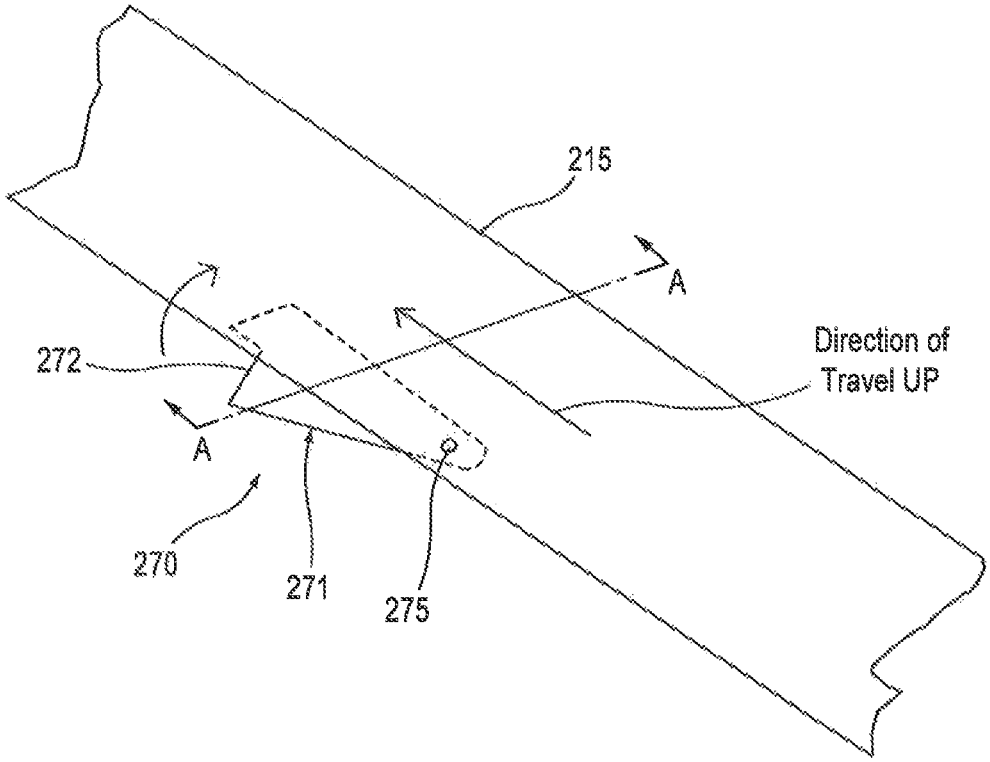
FIG. 13 is a top perspective view of a portion of a track section and an exemplary anti-reverse system, in accordance with aspects of the present invention.
Figure 14:
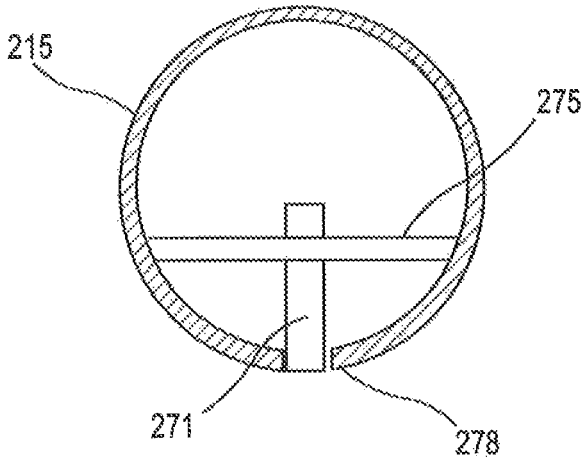
FIG. 14 is a cross sectional view along line A-A of the track section and anti-reverse system shown in FIG. 13, in accordance with aspects of the present invention.

FIGS. 13 and 14 show yet another exemplary anti-reverse system in accordance with aspects of the present invention. The anti-reverse system 270 consists of at least one cam lever 271 supported and hinged on a cam shaft 275. The cam shaft 275 may be contained internal to the track section 210 and mounted in through-holes provided in the traveler section 215. The cam lever 271 may be shaped to move up and down in a slot 278, for example, provided in the traveler section 215 of a track section 210, with the slot 278 preferably provided in the lower surface of the traveler section 215.

The cam lever 271 extends from a peripheral surface of the track section 210 at an angle, for example. As the trolley assembly 310 translates past the cam lever 271 going in one direction, the cam lever 271 is depressed from a primary position up into the slot 278, allowing passage of the trolley assembly 310. Once the trolley assembly 310 passes the cam lever 271, the cam lever 271 returns to the primary position. With the cam lever 271 in the primary position, if the trolley assembly 310 reverses direction, the trolley assembly 310 will abut against the guard surface 272 of the cam lever 271 and be prevented from further translation in the reverse direction. If the slot 278 and the cam lever 271 are provided on the lower surface of the traveler section 215, gravity may be relied upon for resetting the cam lever 271 to a primary position. Alternatively, springs, spring hinges, or other loading devices may be used to provide cam levers 271 in a variety of locations on the traveler section 215 while providing the intended safety effect. In this manner, an individual connected to the track may ascend with a rising track assembly 200 using stairs, ladders or other rope course type means, for example, while being protected from a fall or an uncontrolled backward slide down a slope by the anti-reverse system.

An assembled track system 100 may be supported to limit the movement of the track assembly in such a manner so as to not be substantially affected by the weight of any particular participant and/or payload. For example, the main cable 400 may be initially suspended using any of a variety of support mechanisms, such as trees, artificial support trusses, brackets attached to rocks, trees and/or man-made anchors, for example. Ropes and/or cables may also be attached directly to the cable 400 and used to laterally position the suspended cable, for example, to provide clearance from natural or man-made objects without interfering with the operation of the conveyance assembly 300 which rides safely below on the suspended track assembly 200. Because the track system 100 is designed and supported in such a manner that the conveyance assembly 370 is unimpeded from the method of suspending the track system, the track system 100 is not limited by length and/or structure.

What is claimed is:

1. A conveyance assembly for movement along a rail in a longitudinal direction, comprising:

a frame including:

at least one undercarriage support partially surrounding a bottom surface of the rail;

a first side wheel mounting plate supported by the frame above a center of the rail, the first side wheel mounting plate rotatably mounting at least one first side wheel on an inner surface of the first side wheel mounting plate; and a second side wheel mounting plate supported by the frame above the center of the rail at an angle to the first side wheel mounting plate, the second side wheel mounting plate rotatably mounting at least one second side wheel on an inner surface of the second side wheel mounting plate, wherein the at least one first side wheel and the at least one second side wheel contact a top surface of the rail and provide a clearance between the frame and the rail; and a bracket rotatably mounted to the frame on an axis perpendicular to the longitudinal direction.

2. The conveyance assembly of claim 1, wherein the first side wheel mounting plate and the second side wheel mounting plate define a transverse clearance therebetween that is smaller than a transverse width of the rail.

3. The conveyance assembly of claim 2, wherein the first side wheel and the second side wheel each have an outer diameter that extends beyond an edge of the respective first side wheel mounting plate and the second side wheel mounting plate.

4. The conveyance assembly of claim 1, further comprising at least one roller extending from a lateral lower portion of the bracket, wherein the at least one roller contacts a rail when the bracket rotates beyond a threshold angle and prevents further rotation of the bracket.

5. The conveyance assembly of claim 4, wherein the at least one roller provides resistance to longitudinal movement when the roller contacts the rail.

6. The conveyance assembly of claim 5, wherein the roller is actuatable to extend toward the rail.

7. The conveyance assembly of claim 1, wherein the bracket is rotatably mounted to the first side wheel mounting plate and the second side wheel mounting plate.

8. The conveyance assembly of claim 1, wherein the frame is open above the rail.

9. The conveyance assembly of claim 1, wherein the at least one first side wheel or the at least one second side wheel includes a beveled inner surface.

10. The conveyance assembly of claim 1, wherein the at least one first side wheel and the at least one second side wheel are unrestricted from translating circumferentially about the rail.

11. The conveyance assembly of claim 1, further comprising a transport assembly attached to the bracket.

12. The conveyance assembly of claim 11, wherein the transport assembly is a seat harness for a person.

13. The conveyance assembly of claim 1, further comprising at least two pawls mounted to the frame to allow forward longitudinal movement past a linear rack located on the rail but prevent reverse longitudinal movement past the linear rack.

14. The conveyance assembly of claim 1, further comprising a braking mechanism mounted to the bracket.

15. The conveyance assembly of claim 14, wherein the braking mechanism is electronically actuated.

16. The conveyance assembly of claim 14, wherein the braking mechanism includes a hinge and pulley configured to actuate a friction device toward the rail.

* * * * *